US005299406A

United States Patent [19]

Laury

[11] Patent Number: 5,299,406

[45] Date of Patent: Apr. 5, 1994

[54] PROCESS AND MACHINE FOR WRAPPING LUGGAGE OF USERS OF DIFFERENT TRANSPORT MEANS

[75] Inventor: Daniel J. Laury, Neuilly, France

[73] Assignee: Probag, Neuilly-sur-Seine, France

[21] Appl. No.: 925,398

[22] Filed: Aug. 4, 1992

[30] Foreign Application Priority Data

Aug. 7, 1991 [FR] France ..... 91 10075

[51] Int. Cl.[5] ..... B65B 9/02

[52] U.S. Cl. ..... 53/397; 53/413; 53/442; 53/134.1; 53/557; 53/586

[58] Field of Search ..... 53/397, 413, 442, 553, 53/557, 134.1, 586, 594, 466

[56] References Cited

U.S. PATENT DOCUMENTS

| | | | |
|---|---|---|---|
| 2,705,857 | 4/1955 | Fox | 53/553 X |
| 2,909,877 | 10/1959 | Cummings | 53/553 X |
| 3,447,280 | 6/1969 | Cunningham | 53/134.1 X |
| 3,513,622 | 5/1970 | Timmerbeil | 53/553 X |
| 3,815,313 | 6/1974 | Heisler | 53/442 X |

FOREIGN PATENT DOCUMENTS

| | | | |
|---|---|---|---|
| 1014219 | 12/1965 | United Kingdom . | |
| 1255004 | 11/1971 | United Kingdom | 53/413 |
| 1341644 | 12/1973 | United Kingdom | 53/442 |
| WO87/00144 | 1/1987 | World Int. Prop. O. . | |

*Primary Examiner*—John Sipos

*Attorney, Agent, or Firm*—McAulay Fisher Nissen Goldberg & Kiel

[57] ABSTRACT

A process and a machine for overpacking luggage of users of different transport means and in particular, for airplane passengers.

The machine includes a device for forming a packing around each luggage (5), moving the luggage upon a conveyor belt (8) and during its movement, providing the packing in the form of a protecting envelope (16) made of a plastic material, while providing the envelope (16) with an opening extending in front of the handle (6).

14 Claims, 4 Drawing Sheets

PROCESS AND MACHINE FOR WRAPPING LUGGAGE OF USERS OF DIFFERENT TRANSPORT MEANS

BACKGROUND OF THE INVENTION

1. Field of the Invention

The present invention is concerned with a process and a machine for packing the luggage of users of different transport means and in particular of airplane passengers.

2. Description of the Prior Art

Luggage, such as rigid or soft valises, bags, golf bags, skis, etc..., of passengers of transport means and in particular of airplanes often undergo, during travel, damages resulting from impact, rubbing or weathering. Besides, even if they have safety locks, these can be broken apart during their handling and the owners of the luggage are left with just the possibility of observing the theft they have suffered when they pick up their luggage. Finally, they can be opened for terrorist attempts by installing an exploding device inside.

As is described in the document WO87/00144, an automatic protecting wrapping machine intended to be used with luggage of different sizes is already known. This machine comprises movable means to move the luggage toward a tunnel oven equipped with thermo-retractable means, the luggage being wrapped into a thermo-shrinkable plastic material welded all around each luggage, in such a way as to constitute a continuous envelope which is totally closed. Optical detecting means are provided to detect the sizes of different luggage and to correlatively control the operation of welding parts for welding the sheet of plastic material around each piece of luggage.

SUMMARY OF THE INVENTION

The present invention seeks to simplify and improve such a machine and has for its purpose to provide a process and a machine ensuring, automatically and by very simple means, protection of the luggage of passengers, regardless of their sizes, while facilitating their later handling once these baggages are over-wrapped.

For this purpose this process for over-wrapping luggage which have, at least on one of their surfaces, a carrying handle, is characterized in that there is formed about each luggage, a protective envelope of plastic material in contact with the outer surface of the luggage with the exception of a part left open in order to permit access to the carrying handle, once the protective envelope is placed around the luggage.

The invention also has for its object a machine for over-wrapping luggage of different sizes and shapes of users of different transport means which has, on at least one of their surfaces, a carrying handle, comprising means for forming about each piece of luggage, a protective envelope made of plastic material, characterized in that the means for forming the envelope are arranged in such a way as to leave, in this envelope, an opening extending in front of the luggage handle.

According to one particularly advantageous embodiment, the over-wrapping machine according to the invention, using at least one thermo-shrinkable sheet of plastic material, comprises means for forming around each luggage, from this sheet, a tubular envelope from this sheet which is open at its two ends and a shrinking oven tunnel through which later pass, on a carrier, successive luggage surrounded by their respective tubular protective envelopes, characterized in that the means for forming the envelope are arranged in such a way that this envelope overlaps slightly outwardly relative to the surface of the luggage carrying the handle and that, on the contrary, it exceeds outwardly with respect to the surface of the luggage opposed to the preceding one, along a distance which is variable with respect to the size of the baggage so that there is obtained, at the end of the tunnel oven, following the shrinkage of the plastic material, luggage completely over-wrapped with the exception of an opening which is formed, during the shrinking of the thermo-shrinkable envelope, on the side where is located the carrying handle and in front thereof.

BRIEF DESCRIPTION OF THE DRAWINGS

There will be described hereafter, by way of non-limiting examples, different embodiments of the present invention, reference being had to the accompanying drawing wherein.

DESCRIPTION OF THE PREFERRED EMBODIMENTS

Figure 1:
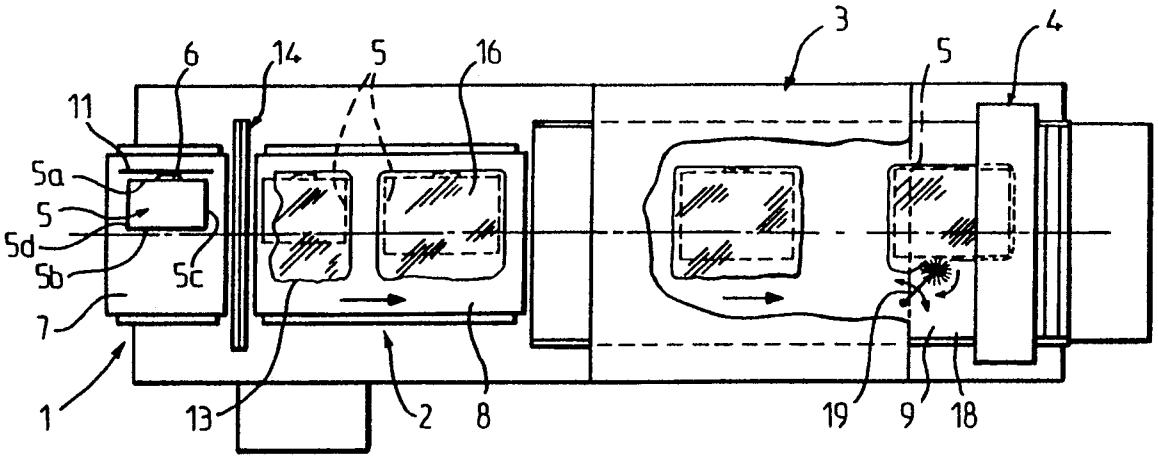
FIG. 1 is a schematic view of one type of an automatic over-wrapping machine for the luggage of passengers according to the invention, forming, around each baggage, a protective envelope made of heat-shrinkable plastic material.
Figure 2:
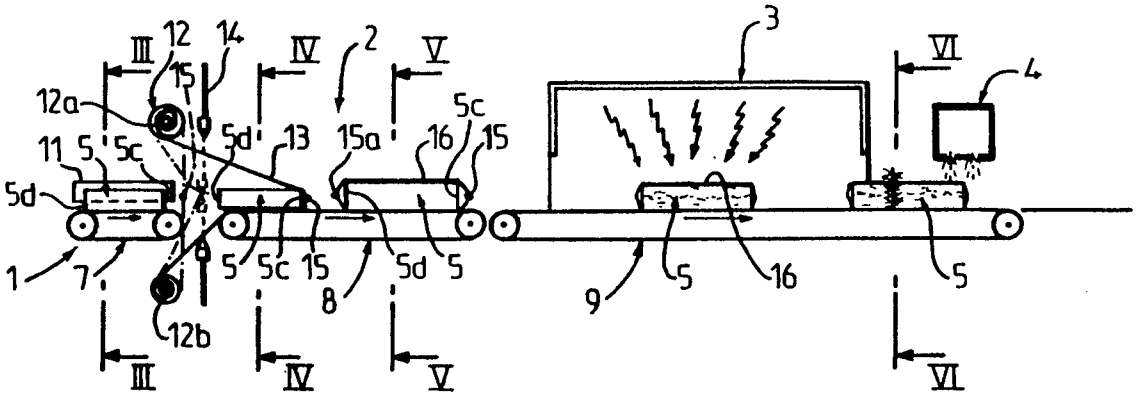
FIG. 2 is a vertical cross-sectional view schematically longitudinal of the machine shown in FIG. 1.

The automatic machine according to the invention, which is shown schematically along FIGS. 1 and 2, is intended to form, around the passenger's luggage, a damage preventing envelope which damage could be caused to the luggage during its transport, with respect to the objects contained in the luggage and which can be stolen, as well as for preventing an unauthorized opening of the luggage for any reason during its handling.

The machine according to the invention comprises successively, from front to back, a post 1 where the luggage arrives, a post 2 for forming a tubular protective envelope, made of shrinkable thermoplastic material, around each luggage, a tunnel oven 3 for shrinking the plastic material and a cooling device 4. Baggage 5 which must be wrapped and which can be valises, bags, etc..., generally have a surface 5a on which or to which is secured a carrying handle 6. Luggage 5 is displaced, through successive posts 1–4 of the machine, by means of an entry carrier 7 which includes several endless carriers horizontally and longitudinally driven in the same direction, that is as viewed in the drawing from the left to the right along FIGS. 1 and 2, and an intermediate wrapping carrier 8 and a rear carrier 9 extending through the shrinking oven 3.

Luggage 5 is placed flat onto the front carrier 7 and is placed onto this carrier in such a way so that all the pieces of luggage are in the same longitudinal position. Stated another way, they are disposed in such a way that their length extends in the longitudinal direction of the machine and that the surface 5a of each individual piece of luggage on which each individual carrying handle 6 is secured, is placed against a lateral stop 11 which is formed by a vertical and longitudinal plate extending above carrier i, on one side thereof, such as on the left side in the directional movement as shown in FIG. 1. This stop 11 thus defines a reference plane which is vertical and longitudinal for positioning the luggage 5 on the front carrier 7 and for the successive over-wrapping operations.

At the end of the front carrier 1 luggage 5 passes through a wrapping post 2 comprising the intermediate carrier 8. This wrapping post can be of any known type, for example that used in carrying machines used in particular for the distribution of food products. Accordingly, post 2 will not be described in detail and it is enough to indicate that this post comprises a device 12 in order to form in the space between the two carriers 7 and 8, a vertical and transverse curtain formed by at least one sheet 13 of heat-shrinkable plastic. In the non-limiting embodiment shown in FIGS. 1 and 2 sheet 13 in fact is constituted by two sheets transversely welded therebetween and respectively unwound from two spools, an upper one 12a and a lower one 12b, which have horizontal and transverse axes. The two parts forming the sheet 13 are welded one to the other during passage of the preceding luggage, being met by the downstream transverse face 5c of each luggage 5 and driven downstream by the luggage, as is shown in FIG. 2. Transverse means 14 for cutting and welding, which comprise welding jaws and a cutting blade, is provided a little downstream of the device 12 which feeds sheet 13, in order to form, below the luggage, on the one hand, a transverse joint 15 between the two sheets which come out of the two spools 12a, 12b, to reconstitute the continuous vertical sheet 13 and, on the other hand, another joint which is transverse at 15a near the transverse surface above 5d of luggage 5 having driven the sheet 13, as well as a transverse cut between the two joints 15 and 15a. After the passage of each luggage 5 through sheet 13, the luggage 5 is provided above it with a tubular envelope 16 which is obtained by unwinding sheet 13 around baggage 5 and more particularly about a transverse direction that is perpendicular to the face 5a having the handle of the luggage 6 attached thereto, and this tubular envelope is defined by the opposite transverse welding joints 15 and 15a.

Figure 4:
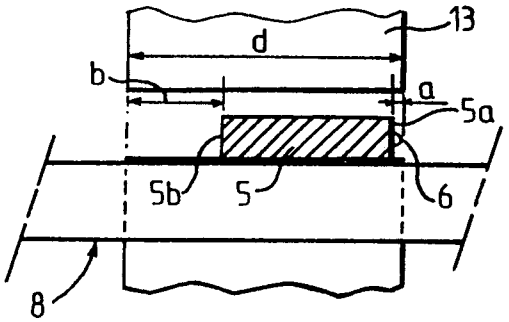
FIGS. 3, 4, 5 and 6 are schematic views in vertical and transverse cross-section, on a larger scale, taken respectively along the lines III—III, IV—IV, V—V and VI—VI of FIG. 2.
Figure 6:
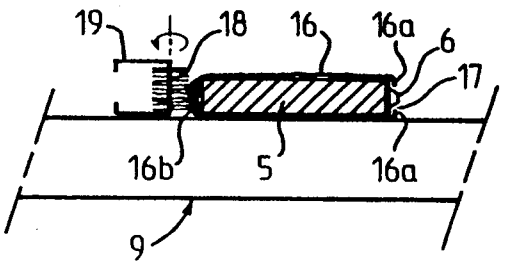
Figure 3:
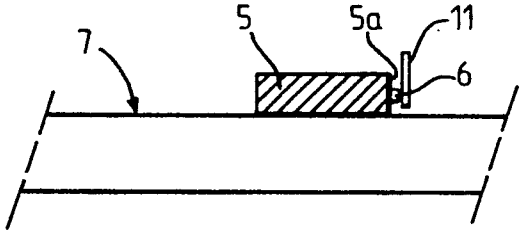
Figure 5:
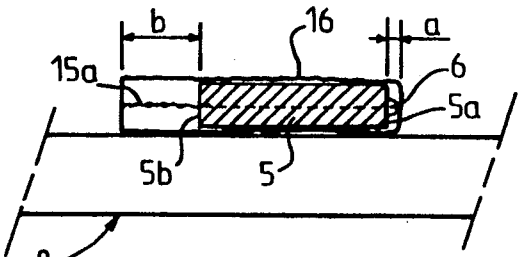

In the wrapping post 2, spools 12a and 12b of the feed device 12 for the sheet of heat-shrinking material 13 are placed transversely relative to the lateral stop 11 which determines the transverse position of luggage 5, in such a way that the tubular envelope 16 formed by sheet 13 about each piece of luggage 5 extends slightly outwardly, in the transverse direction, by a small distance a (FIGS. 4 and 5), relative to the surface 5a of luggage 5 which has handle 6. However, sheet 13 which is selected such as the width d be sufficiently large to exceed the largest dimension of luggage 5 in a direction perpendicular to its surface 5a carrying handle 6, overlaps more or less by a distance b, relative to the opposite longitudinal surface 5b of luggage 5, as can be seen in FIGS. 4 and 5. Naturally, at the exit of the wrapping post 2, envelope 16 is open at its two extremities, in the transverse direction of the machine, thus allowing to appear the entirety of the longitudinal surfaces 5a and 5b of luggage 5.

Figure 7:
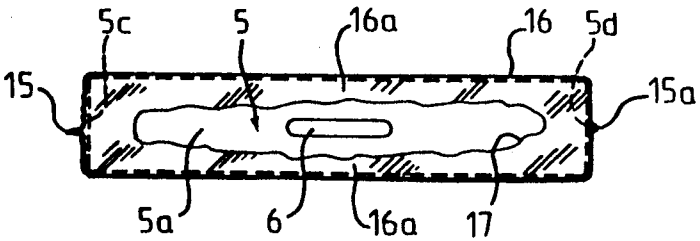
FIG. 7 is a front view of a baggage over-wrapped according to the invention, seen from the side on which the carrying handle is located.

Luggage 5 thus provided with its tubular envelope 16 then passes on a moving carpet located below at 9 and is driven by the latter through the shrinking oven tunnel 3. The tubular envelope 16 shrinks then on all sides on luggage 5 and the end portions of sheet 13, which project slightly by distance a, relative to the longitudinal surface 5a of luggage 5, shrink only along a small width of this longitudinal surface 5a, from each longitudinal peak of the luggage. These shrunk portions 16a, which are narrow, of envelope 16 appear clearly in FIG. 7 and it is seen that they define therebetween an elongated opening 17 through which appears the handle 6 and which allows access thereto.

Preferably the machine according to the invention is provided, at the exit of the shrinking oven 3, with a smoothing brush 18 which is carried by a mobile support 19 in such a way as to be borne against the mass 16b of envelope 16, while it is still soft, and which is located in front of the longitudinal surface 5b of luggage 5. This soft mass is more or less important according to the extra distance b of tubular envelope 16, that is according to the size of the luggage in the direction perpendicular to its longitudinal surfaces 5a and 5b. The brush 18 makes it possible to apply and to crush against the longitudinal surface 5b of luggage 5, the excess plastic material of mass 16b, in order to make the corresponding surface of the cooled envelope as flat as possible.

After passing under the cooling device 4, of any known type, with blowing of cold air from below to above, envelope 16 is then completely cooled and hardened and the luggage 5 thus wrapped can then be evacuated, and is thus protected, for the following part of its transport. The cooling device also makes it possible to cool the rollers of conveyor 9 which pass in the tunnel oven 3, and owing to that the length of the conveyor can be slightly diminished.

Figure 10:
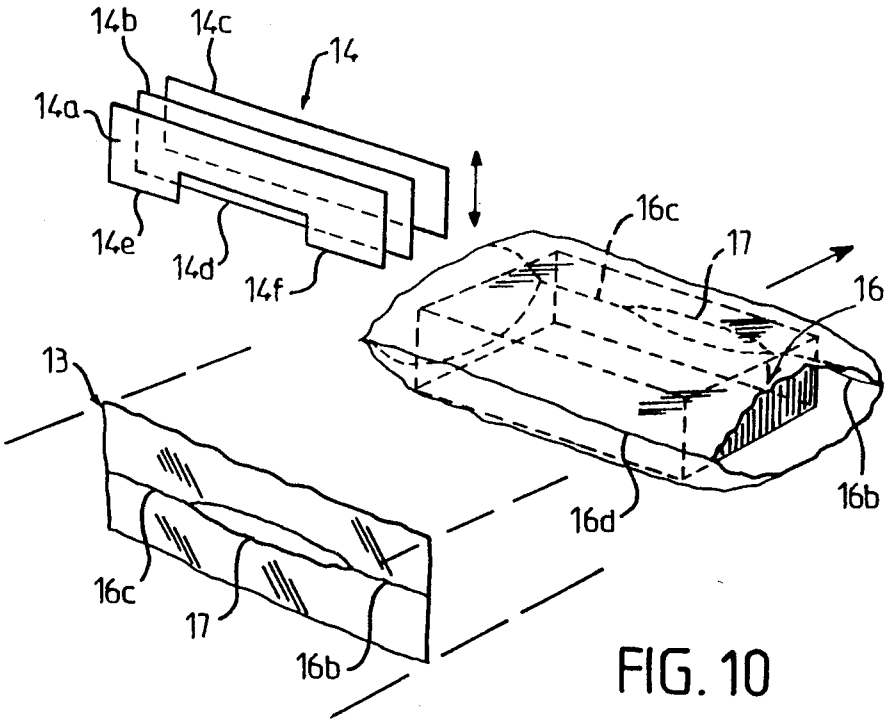
FIG. 10 is a view in partial perspective showing the back of an over-wrapped luggage, obtained after welding of its envelope in the machine shown in FIGS. 8 and 9, and the device for welding and cutting.
Figure 8:
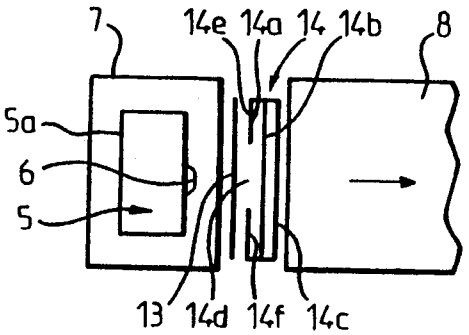
FIG. 8 is a partial schematic plan view of a modification of the over-wrapping machine for luggage.
Figure 9:
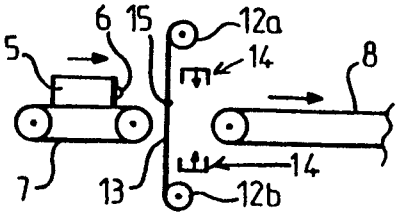
FIG. 9 is a partial elevational schematic view of the machine shown in FIG. 8.
Figure 11:
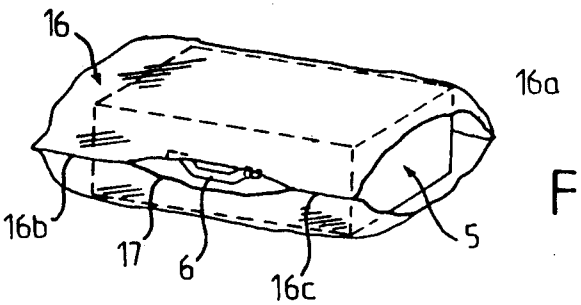
FIG. 11 is a perspective view showing the front of the over-wrapped luggage shown in FIG. 10.
Figure 12:
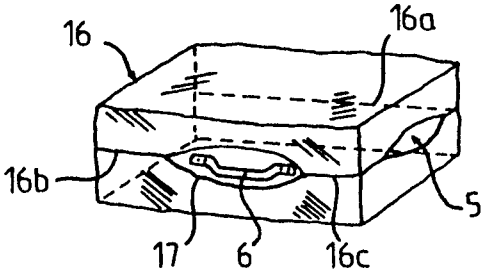
FIG. 12 is a perspective view of the luggage shown in FIGS. 10 and 11 after thermal shrinking of its envelope.

In the embodiment of the machine shown in FIGS. 8 and 9, the luggage 5 is placed flat on the carrier 7 in such a way that its length extends in the direction transverse of the machine and that the surface 5a of each luggage on which is fixed a handle 6 be located forward, that is, turned toward the back end of the machine or toward the right in FIGS. 8 and 9. Besides, the transverse welding and cutting device 14 comprises three elements, on each side of the horizontal plane of movement of luggage 5; one of the three elements is a welding jaw 14a upstream, the second element is an intermediate cutting blade 14b and the third element is a downstream welding jaw 14c which extends vertically and transversely. In the machine according to the invention the downstream jaw 14c is continuous, that is to say it extends along the entire length of the transverse welding zone, while on the contrary the upstream welding jaw 14*a* is discontinuous in its central part 14*d*, in order to comprise only two opposite lateral surfaces 14*e* and 14*f*. Consequently, when the tubular envelope 16 has been formed as a result of its welding on both sides of luggage 5, as is shown in FIGS. 10 and 11, this envelope 16 has, on one or the upstream side, a continuous transversal welding joint 16*d* and, on the other or downstream side, two distinct welding joints 16*b*, 16*c*, extending transversely and spaced apart from one another in such a way as to define therebetween an elongated opening 17 through which appears the handle 6 of the luggage. After the passage in the oven tunnel for heat shrinkage, there is obtained a luggage wrapped as shown in FIG. 12. It is seen also in FIG. 10 that the vertical sheet 13, which is waiting for the following luggage, has a horizontal and transversal opening 17, between the two lateral welding joints 16*b*, 16*c*, in which opening penetrates the handle 6 of the following piece of luggage.

Figure 13:
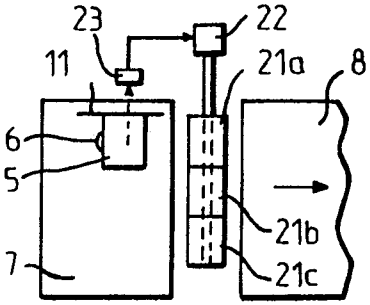
FIGS. 13, 14, and 15 schematic plan views of another embodiment of the over-wrapping machine according to the invention, used with luggage of different sizes.
Figure 14:
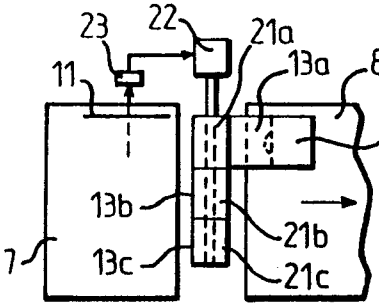
Figure 15:
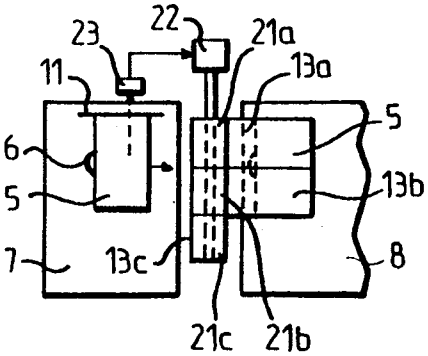

In the embodiment of the machine which is shown schematically in FIGS. 13 and 15, the vertical and transversal curtain in which are engaged each piece of luggage 5 is disposed transversely as in the case of the machine shown in FIGS. 8 and 9 and the vertical and transversal curtain is formed of several sheets of heat-shrinkable plastic material issuing from several spools mounted side by side, for example three feed spools 21*a*, 21*b* and 21*c*, that is to say sheets 13*a*, 13*b*, 13*c* which extend vertically between the upper and lower feed spools 21*a*, 21*b*, 21*c* which are adjacent to one another and located in the same vertical and transversal plane. Spools 21*a*, 21*b*, 21*c* of the respective sheets 13*a*, 13*b*, 13*c* are mounted coaxially and they can be selectively rotated by means of a common driving device 22, through the agency of respective clutch devices. The driving device 22 is controlled by a detector 23 which detects the length of each piece of luggage 5 placed onto the upper carrier 7, that is its largest size in the transverse direction of the machine. In this way, when the luggage 5 has to be wrapped along a small length, as indicated in FIGS. 13 and 14, the detector 23 emits an order toward the driving device 22 in such a way so as to rotate the first spool issuing sheet 13*a*. Owing to this fact the luggage 5 is uniquely wrapped with the sheet 13*a* which corresponds substantially to its length.

However, if the luggage 5 placed on the upper conveyor 7 is longer, as shown in FIG. 15, the detector 23 emits a signal towards the driving device 22 which causes the driving of the two spools 21*a* and 21*b*, in order to unroll simultaneously the two sheets 13*a* and 13*b*. These two sheets then constitute two adjacent tubular envelopes around luggage 5.

Naturally a piece of luggage 5 having a still greater length would put into play or use the third spool 21*c*.

The machine shown schematically in FIGS. 13 and 15 thus makes it possible to reduce the use of sheets of plastic material, by using for each piece of luggage one or two sheets in order to obtain one or two tubular envelopes proportioned to the length of the luggage.

Figure 16:
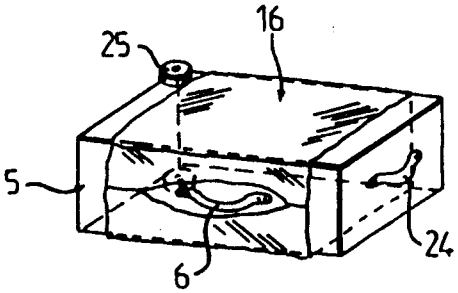
FIG. 16 is a perspective view of a luggage over-wrapped by mean of a heat-shrunk band.

FIG. 16 shows schematically a luggage 5 wrapped in an envelope 16 forming a band and having, in addition to its carrying handle 6, an auxiliary handle 24, on a lateral surface left open by the heat-shrunk tubular envelope 16 and which is opposite to rollers 25 rotatably mounted at an opposite angle of luggage 5.

Naturally the heat-shrunk plastic tubular envelope 16 could also be shaped manually on a commercial wrapping machine of the type "L welder". In this case, the welding jaw which is located in front of the surface of the baggage carrying handle 6 would be interrupted in its central part, as the jaw 14*a* of FIG. 10, to form an opening 17 in front of handle 6.

During the exit of the passengers and the delivery of the baggage, the latter can be returned to their owners either while still provided with their protective envelopes 16, or after having been rid of these envelopes. The plastic envelopes 16 thus recovered can then be chopped up to be recycled in the manufacture of other plastic materials.

Although, in the foregoing description, it has been indicated that each baggage 5 was wrapped by means of a protective envelope made of a heat-shrinkable material, it will be understood that this envelope could also be made of any other plastic material which can be rapidly and easily put in place around each luggage 5, while however leaving an opening in front of the handle.

Notably it would be possible to carry out the process of the invention in a machine which uses a material which can be projected in a fluid state on the luggage and hardening rapidly, or still a material forming a foam shell made of an alveolar or a type of foam. However it would be necessary then to provide, in this case, zones of lesser resistance making it possible to easily tear out the "skin" constituting the wrapping, during the return of the luggage to the passengers.

It also would be possible to use, in the place of a smooth plastic sheet 13, a sheet of plastic material having "bubbles" which would aid in dampening shocks.

I claim:

1. A machine for wrapping individual pieces of luggage which have different shapes and sizes and are used in different transportation means and in particular for airborne passengers and wherein each said piece of luggage is provided with a carrying handle on one of its lateral surfaces, comprising:

three endless carriers positioned horizontally and longitudinally;

means for driving said endless carriers in the same direction;

said endless carriers including an upstream entrance carrier, an intermediate wrapping carrier and a downstream carrier;

a vertical and longitudinal plate extending above said upstream entrance carrier, on one side thereof, defining a vertical and longitudinal reference plane, and constituting a lateral stop for the lateral surface, provided with the handle, of each piece of luggage placed flat on said upstream carrier for positioning said luggage on said entrance carrier;

means for forming, in the space between said upstream entrance carrier and said intermediate wrapping carrier, a vertical transverse curtain formed by at least one sheet of heat-shrinkable material with one edge of said curtain in close proximity to said vertical plate so that said lateral surface provided with the handle positioned against said plate is in close proximity to said one edge of said curtain and with the lateral surface opposite the handle is at a greater distance from the other edge of the curtain;

said intermediate wrapping carrier comprising means for passing said piece of luggage through the curtain of heat shrinkable material to form a protective tubular envelope around each said luggage, open at its two extremities with a short portion extending laterally on said handle containing surface and a longer portion extending laterally on said opposite surface; and a shrinking oven tunnel through which passes successive pieces of luggage surrounded by its respective tubular protective envelope, upon said downstream carrier, said tunnel includes means for shrinking the envelope and to overlap it slightly externally relative to the surface of the luggage to which is attached said carrying handle while leaving the handle exposed and for completely shrinking and overlapping said opposite portion for obtaining at the exit of said oven tunnel, after shrinkage of the plastic material, a luggage totally wrapped with the exception of an opening which is formed, during the shrinkage of the heat-shrinkable envelope, on the side where the carrying handle is located and in front thereof.

2. The machine according to claim 1, comprising:

at the exit of said shrinking oven, a smoothing brush carried by a mobile support and bearing against a mass of said tubular envelope, while it is soft, and then projecting laterally beyond the surface of the luggage opposite to the surface to which is attached said carrying handle.

3. The machine according to claim 1, comprising:

a cooling device downstream of said shrinking oven for blowing cold air onto each piece of the luggage provided with its envelope and onto said carrier of said tunnel oven, in order to cool and shorten it.

4. The machine according to claim 2, comprising:

a cooling device downstream of said shrinking oven for blowing cold air onto each piece of the luggage provided with its envelope and onto said carrier of said tunnel oven, in order to cool and shorten it.

5. The machine according to claim 1, wherein:

said means for forming said protective tubular envelope around each luggage comprises a transverse welding and cutting device including an upstream welding jaw, an intermediate cutting blade and a downstream welding jaw which extending vertically and transversal on each side of the horizontal plane of transport of the luggage; and said downstream welding jaw being continuous and extending along the entire length of the transverse welding zone, while on the contrary said upstream welding jaw, in a central part thereof, has an interruption so that said upstream welding jaw comprises only two opposite lateral active parts.

6. The machine according to claim 2, wherein:

said means for forming said protective tubular envelope around each luggage comprises a transverse welding and cutting device including an upstream welding jaw, an intermediate cutting blade and a downstream welding jaw which extend vertically and transversely on each side of the horizontal plan of transport of the luggage; and said downstream welding jaw being continuous and extending along the entire length of the transverse welding zone, while on the contrary said upstream welding jaw, in a central part thereof, has an interruption so that said upstream welding jaw comprises only two opposite lateral active parts.

7. The machine according to claim 3, wherein:

said means for forming said protective tubular envelope around each luggage comprises a transverse welding and cutting device including an upstream welding jaw, an intermediate cutting blade and a downstream welding jaw which extend vertically and transversely on each side of the horizontal plan of transport of the luggage; and said downstream welding jaw being continuous and extending along the entire length of the transverse welding zone, while on the contrary said upstream welding jaw, in a central part thereof, has an interruption so that said upstream welding jaw comprises only two opposite lateral active parts.

8. The machine according to claim 4, wherein:

said means for forming said protective tubular envelope around each luggage comprises a transverse welding and cutting device including an upstream welding jaw, an intermediate cutting blade and a downstream welding jaw which extend vertically and transversely on each side of the horizontal plan of transport of the luggage; and 'said downstream welding jaw being continuous and extending along the entire length of the transverse welding zone, while on the contrary said upstream welding jaw, in a central part thereof, has an interruption so that said upstream welding jaw comprises only two opposite lateral active parts.

9. A process for wrapping individual pieces of luggage which have different shapes and sizes and are used in different transportation and in particular for airborne passengers and wherein each said piece of luggage is provided with a carrying handle on one of its lateral surfaces, and forming around each piece of luggage a protective envelope of plastic material in contact with the external surface of the luggage with the exception of an area left open in order to provide access to the carrying handle, once the protective envelope is positioned around the luggage, comprising:

providing three endless carriers positioned horizontally and longitudinally and driving the endless carriers in the same direction, the endless carriers including an upstream entrance carrier, an intermediate wrapping carrier and a downstream carrier, a vertical and longitudinal plate extending above the upstream entrance carrier, on one side thereof, defining a vertical and longitudinal reference plane, and constituting a lateral stop for the lateral surface, provided with the handle, of each piece of luggage placed flat on said upstream carrier;

forming, in the space between the upstream entrance carrier and the intermediate wrapping carrier, a vertical transverse curtain formed by at least one sheet of heat-shrinkable wrapping material with one edge of said sheet curtain being in close proximity to said plate;

positioning said luggage with said lateral surface provided with the handle against said plate so that said lateral surface is in close proximity to said one edge of said curtain and with the lateral surface opposite the handle is at a greater distance from the other edge of the curtain;

passing said luggage through said curtain to form from the one sheet of heat shrinkable material, a protective tubular envelope around each luggage, open at its two extremities with a short portion extending laterally on said handle containing surface and a longer portion extending laterally on said opposite surface;

passing successive pieces of luggage surrounded by its respective tubular protective envelope through a shrinking oven tunnel upon the downstream carrier to shrink the envelope and to overlap it slightly externally relative to the surface of the luggage to which the carrying handle is attached while leaving the handle exposed and completely shrinking and overlapping said opposite surface for obtaining, at the exit tunnel oven, after shrinkage of the plastic material, a luggage totally wrapped with the exception of an opening which is formed, during the shrinkage of the heat-shrinkable envelope, on the side on which the carrying handle is located and in front thereof.

10. The process according to claim 9, including partially sealing the plastic material adjacent to the surface having the handle to leave an area open through which the handle projects.

11. The process according to claim 9, including:

moving the baggage with the protective envelope through the shrinking oven tunnel for shrinking the plastic material on all surfaces except the rear surface leaving the portions which project beyond the one surface and the rear surface, and sealing the plastic material at the rear surface and at part of the rear surface.

12. The process according to claim 9, comprising blowing cold air onto each piece of the luggage provided with its envelope and onto the carrier of the tunnel oven for cooling and shortening the envelope.

13. The process according to claim 9, wherein the protective tubular envelope around each luggage is formed with a transverse welding and cutting device having an upstream welding jaw, an intermediate cutting blade and a downstream welding jaw which extend vertically and transversely on each side of the horizontal plan of transport of the luggage; the downstream welding jaw being continuous and extending along the entire length of the transverse welding zone, while on the contrary said upstream welding jaw, in a central part thereof, has an interruption so that said upstream welding jaw comprises only two opposite lateral active parts.

14. The process according to claim 9, comprising applying a smooth brush carried by a mobile support and a mass of the tubular envelope, while it is still soft, and then projecting laterally beyond the surface of the luggage opposite to the surface to which the carrying handle is attached.

* * * * *